US007484549B2

(12) United States Patent
Jacques et al.

(10) Patent No.: US 7,484,549 B2
(45) **Date of Patent: *Feb. 3, 2009**

(54) CONTINUOUS CASTING OF REACTIONARY METALS USING A GLASS COVERING

(75) Inventors: Michael P. Jacques, Canton, OH (US); Frank P. Spadafora, Niles, OH (US); Kuang-O Yu, Highland Heights, OH (US); Brian W. Martin, McMurray, PA (US)

(73) Assignee: RMI Titanium Company, Niles, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/799,574

(22) Filed: May 2, 2007

(65) Prior Publication Data

US 2007/0204970 A1 Sep. 6, 2007

Related U.S. Application Data

(63) Continuation-in-part of application No. 11/433,107, filed on May 12, 2006, which is a continuation-in-part of application No. 10/989,563, filed on Nov. 16, 2004, now Pat. No. 7,322,397.

(51) Int. Cl.
*B22D 11/04* (2006.01)
*B22D 11/10* (2006.01)

(52) U.S. Cl. ..... 164/416; 164/268

(58) Field of Classification Search ..... 164/416, 164/478, 263, 472, 471, 413, 268
See application file for complete search history.

(56) References Cited

U.S. PATENT DOCUMENTS

| | | | | | |
|---|---|---|---|---|---|
| 2,238,155 | A * | 4/1941 | Cohen | ..... | 266/205 |
| 2,709,842 | A * | 6/1955 | Findlay | ..... | 164/413 |
| 2,858,586 | A * | 11/1958 | Brennan | ..... | 164/471 |
| 2,903,759 | A | 9/1959 | Brennan | | |
| 3,396,778 | A | 8/1968 | Jensen et al. | | |
| 3,470,939 | A | 10/1969 | Coad | | |
| 3,888,300 | A | 6/1975 | Guichard et al. | | |
| 4,024,309 | A | 5/1977 | Pender | | |
| 4,391,319 | A | 7/1983 | Heaslip et al. | | |
| 6,868,896 | B2 | 3/2005 | Jackson et al. | | |
| 7,322,397 | B2 * | 1/2008 | Jacques et al. | ..... | 164/439 |
| 2006/0254746 | A1 * | 11/2006 | Jacques et al. | ..... | 164/268 |

* cited by examiner

*Primary Examiner*—Kevin P Kerns
(74) *Attorney, Agent, or Firm*—Sand & Sebolt

(57) ABSTRACT

A seal for a continuous casting furnace having a melting chamber with a mold therein for producing a metal cast includes a passage between the melting chamber and external atmosphere. As the cast moves through the passage, the cast outer surface and the passage inner surface define therebetween a reservoir for containing liquid glass or other molten material to prevent the external atmosphere from entering the melting chamber. Particulate material fed into the reservoir is melted by heat from the cast to form the molten material. The molten material coats the cast as it moves through the passage and solidifies to form a coating to protect the hot cast from reacting with the external atmosphere. Preferably, the mold has an inner surface with a cross-sectional shape to define a cross-sectional shape of the cast outer surface whereby these cross-sectional shapes are substantially the same as a cross-sectional shape of the passage inner surface.

30 Claims, 12 Drawing Sheets

CONTINUOUS CASTING OF REACTIONARY METALS USING A GLASS COVERING

CROSS REFERENCE TO RELATED APPLICATIONS

This application is a continuation-in-part of U.S. patent application Ser. No. 11/433,107, filed May 12, 2006, which is a continuation-in-part of U.S. patent application Ser. No. 10/989,563, filed Nov. 16, 2004, now U.S. Pat. No. 7,322, 397; the disclosures of which are incorporated herein by reference.

BACKGROUND OF THE INVENTION

1. Technical Field

The invention relates generally to the continuous casting of metals. More particularly, the invention relates to the protection of reactionary metals from reacting with the atmosphere when molten or at elevated temperatures. Specifically, the invention relates to using a molten material such as liquid glass to form a barrier to prevent the atmosphere from entering the melting chamber of a continuous casting furnace and to coat a metal cast formed from such metals to protect the metal cast from the atmosphere.

2. Background Information

Hearth melting processes, Electron Beam Cold Hearth Refining (EBCHR) and Plasma Arc Cold Hearth Refining (PACHR), were originally developed to improve the quality of titanium alloys used for jet engine rotating components. Quality improvements in the field are primarily related to the removal of detrimental particles such as high density inclusions (HDI) and hard alpha particles. Recent applications for both EBCHR and PACHR are more focused on cost reduction considerations. Some ways to effect cost reduction are increasing the flexible use of various forms of input materials, creating a single-step melting process (conventional melting of titanium, for instance, requires two or three melting steps) and facilitating higher product yield.

Titanium and other metals are highly reactive and therefore must be melted in a vacuum or in an inert atmosphere. In electron beam cold hearth refining (EBCHR), a high vacuum is maintained in the furnace melting and casting chambers in order to allow the electron beam guns to operate. In plasma arc cold hearth refining (PACHR), the plasma arc torches use an inert gas such as helium or argon (typically helium) to produce plasma and therefore the atmosphere in the furnace consists primarily of a partial or positive pressure of the gas used by the plasma torches. In either case, contamination of the furnace chamber with oxygen or nitrogen, which react with molten titanium, may cause hard alpha defects in the cast titanium.

In order to permit extraction of the cast from the furnace with minimal interruption to the casting process and no contamination of the melting chamber with oxygen and nitrogen or other gases, current furnaces utilize a withdrawal chamber. During the casting process the lengthening cast moves out of the bottom of the mold through an isolation gate valve and into the withdrawal chamber. When the desired or maximum cast length is reached it is completely withdrawn out of the mold through the gate valve and into the withdrawal chamber. Then, the gate valve is closed to isolate the withdrawal chamber from the furnace melt chamber, the withdrawal chamber is moved from under the furnace and the cast is removed.

Although functional, such furnaces have several limitations. First, the maximum cast length is limited to the length of the withdrawal chamber. In addition, casting must be stopped during the process of removing a cast from the furnace. Thus, such furnaces allow continuous melting operations but do not allow continuous casting. Furthermore, the top of the cast will normally contain shrinkage cavities (pipe) that form when the cast cools. Controlled cooling of the cast top, known as a "hot top", can reduce these cavities, but the hot top is a time-consuming process which reduces productivity. The top portion of the cast containing shrinkage or pipe cavities is unusable material which thus leads to a yield loss. Moreover, there is an additional yield loss due to the dovetail at the bottom of the cast that attaches to the withdrawal ram.

The present invention eliminates or substantially reduces these problems with a sealing apparatus which permits continuous casting of the titanium, superalloys, refractory metals, and other reactive metals whereby the cast in the form of an ingot, bar, slab or the like can move from the interior of a continuous casting furnace to the exterior without allowing the introduction of air or other external atmosphere into the furnace chamber.

BRIEF SUMMARY OF THE INVENTION

The present invention provides an apparatus comprising a continuous casting mold adapted for producing a metal cast having an outer periphery; a metal cast pathway extending downwardly from the mold adapted to allow the metal cast to pass therethrough; a reservoir adjacent the pathway adapted to contain a molten bath for applying a coating of molten material to the outer periphery of the metal cast; a feed path communicating with the reservoir and adapted for feeding solid particles into the reservoir; and a first vibrator adjacent the feed path for vibrating the feed path.

The present invention provides an apparatus comprising a continuous casting mold adapted for producing a metal cast having an outer periphery; a metal cast pathway extending downwardly from the mold adapted to allow the metal cast to pass therethrough; a reservoir adjacent the pathway adapted to contain a molten bath for applying a coating of molten material to the outer periphery of the metal cast; a solid-particle feed path having an exit end communicating with the reservoir and adapted for feeding solid particles into the reservoir; and a cooling device adjacent the exit end of the feed path for cooling the feed path.

The present invention provides an apparatus comprising a continuous casting mold adapted for producing a metal cast having an outer periphery; a metal cast pathway extending downwardly from the mold adapted to allow the metal cast to pass therethrough; a reservoir adjacent the pathway adapted to contain a molten bath for applying a coating of molten material to the outer periphery of the metal cast; a container adapted to contain solid particles; a plurality of conduits communicating with the reservoir and adapted for feeding the solid particles into the reservoir; and a divider in communication with and downstream of the container and in communication with and upstream of the conduits for dividing flow of the particles from the container into the conduits.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
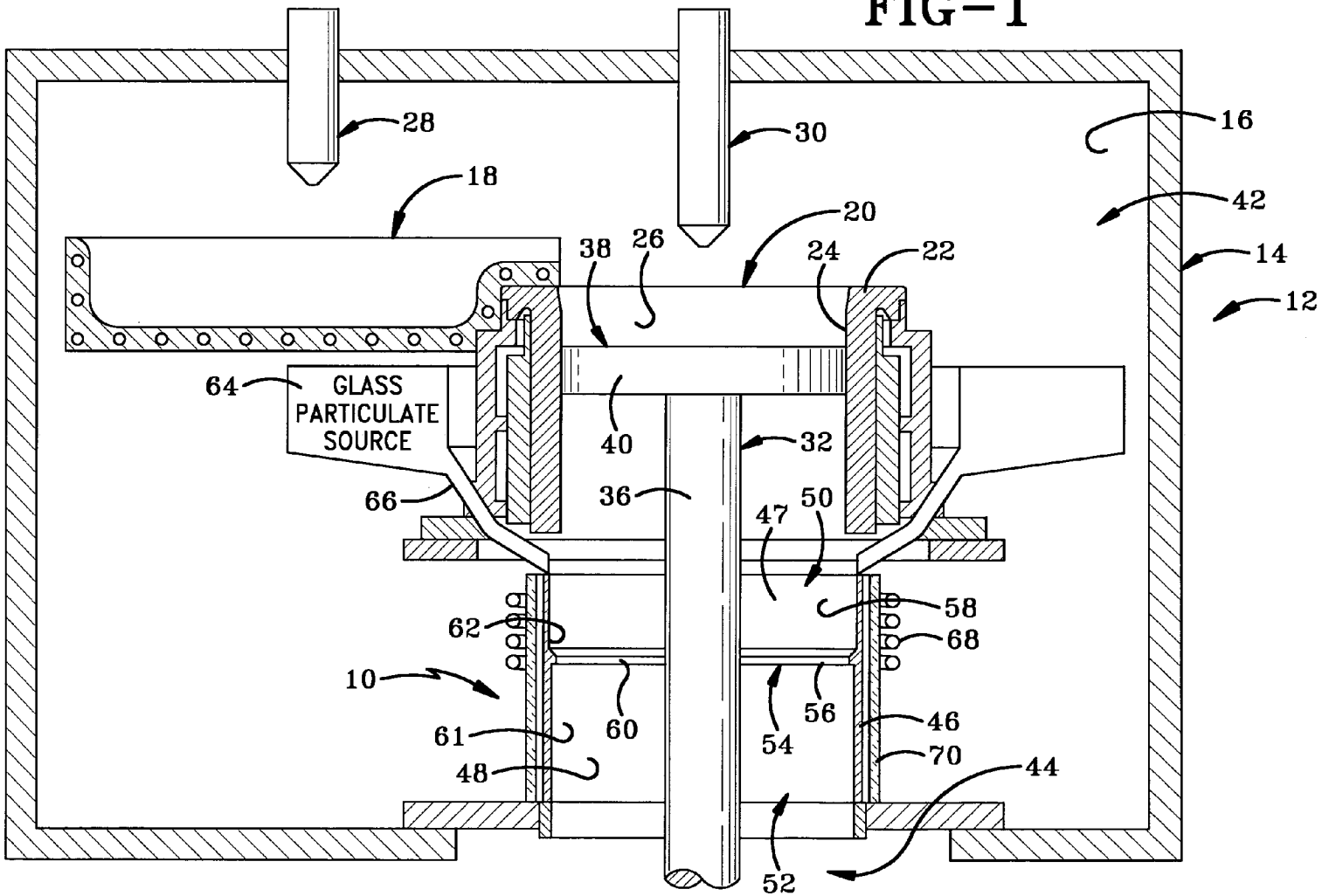
FIG. 1 is a sectional view of the seal of the present invention in use with a continuous casting furnace.

The seal of the present invention is indicated generally at 10 in FIGS. 1-5 in use with a continuous casting furnace 12. Furnace 12 includes a chamber wall 14 which encloses a melting chamber 16 within which seal 10 is disposed. Within melting chamber 16, furnace 12 further includes a melting/refining hearth 18 in fluid communication with a mold 20 having a substantially cylindrical sidewall 22 with a substantially cylindrical inner surface 24 defining a mold cavity 26 therewithin. Heat sources 28 and 30 are disposed respectively above melting/refining hearth 18 and mold 20 for heating and melting reactionary metals such as titanium and superalloys. Heat sources 28 and 30 are preferably plasma torches although other suitable heat sources such as induction and resistance heaters may be used.

Figure 2:
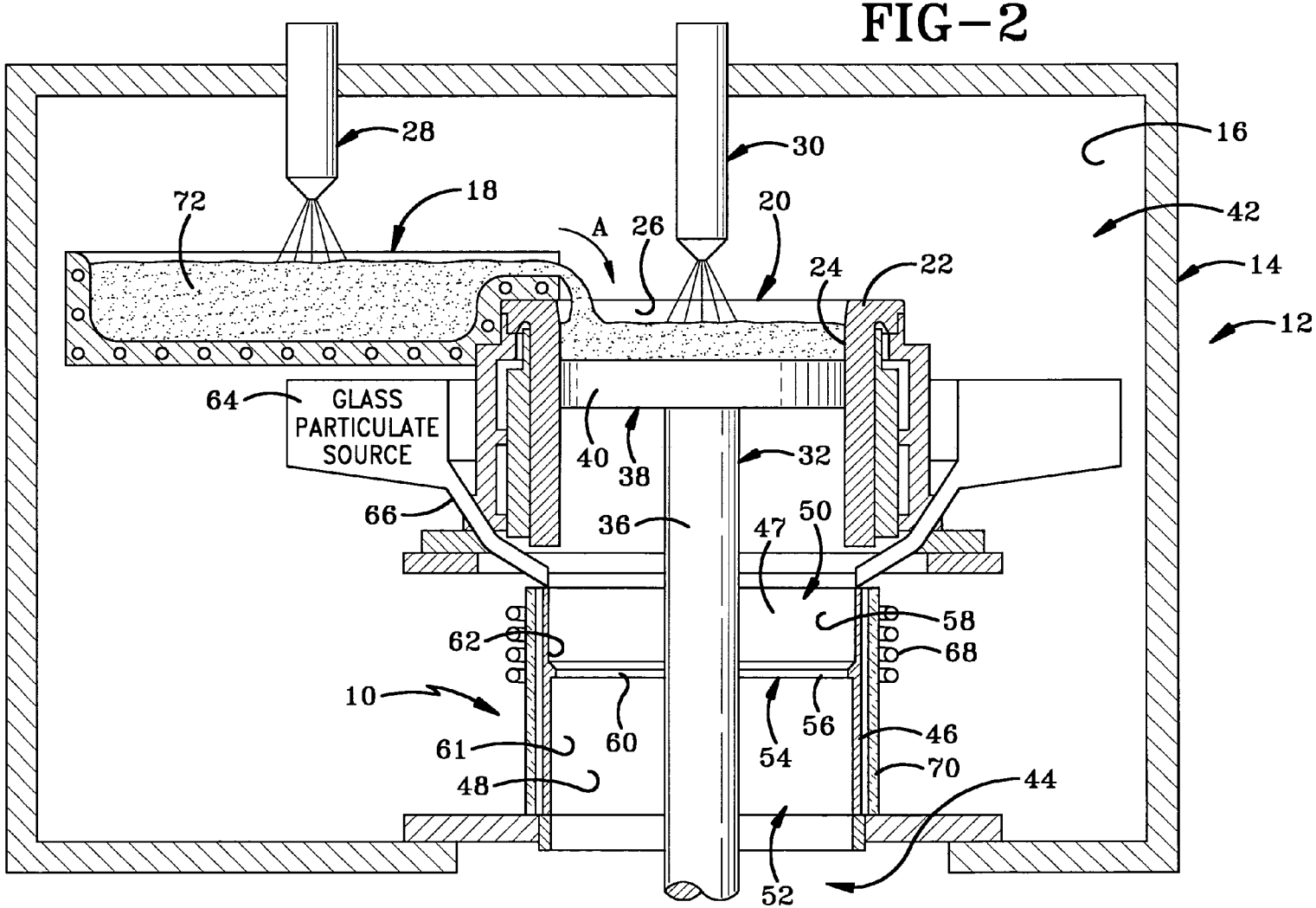
FIG. 2 is similar to FIG. 1 and shows an initial stage of forming an ingot with molten material flowing from the melting/refining hearth into the mold and being heated by heat sources over each of the hearth and mold.
Figure 3:
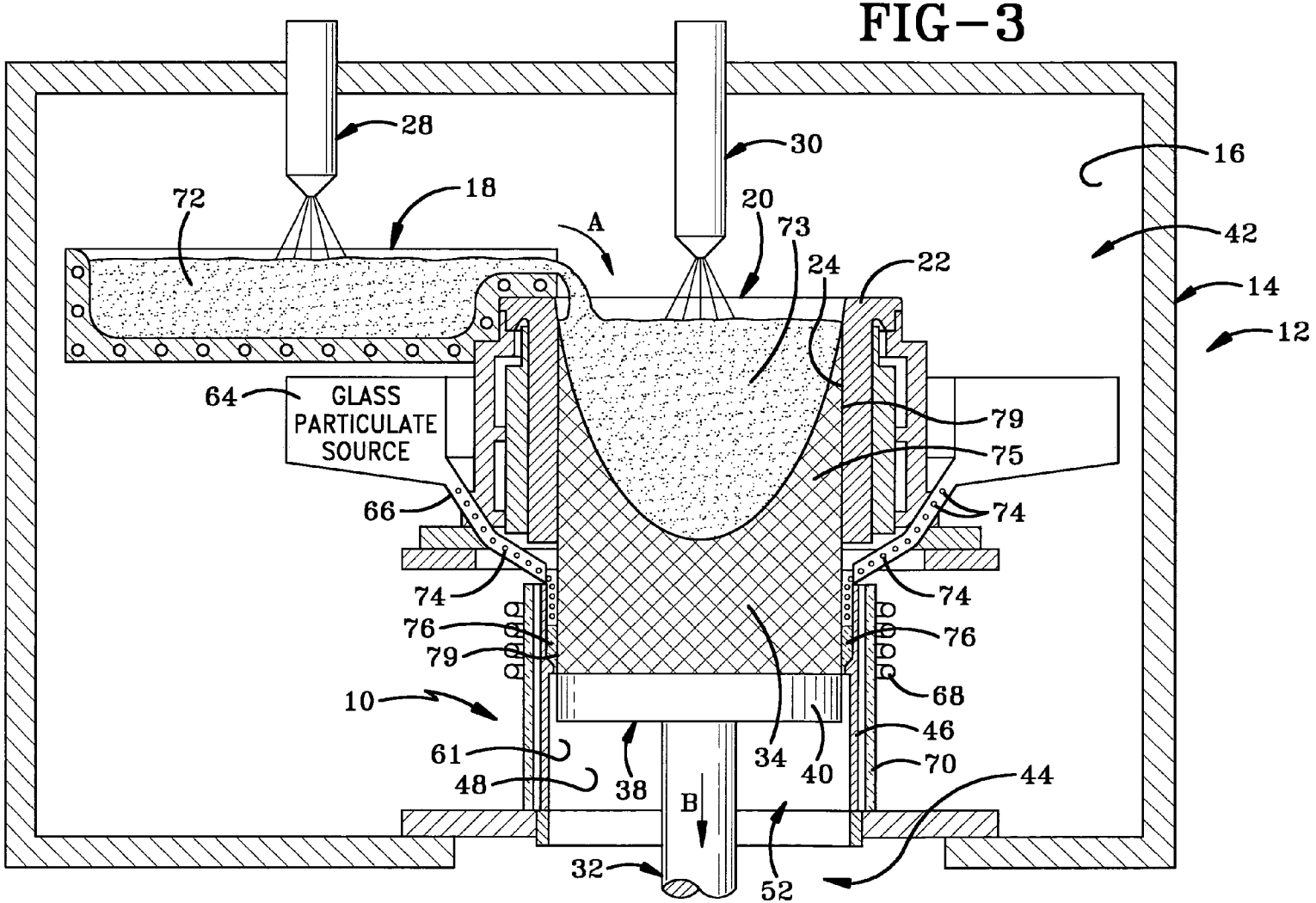
FIG. 3 is similar to FIG. 2 and shows a further stage of formation of the ingot as the ingot is lowered on a lift and into the seal area.
Figure 4:
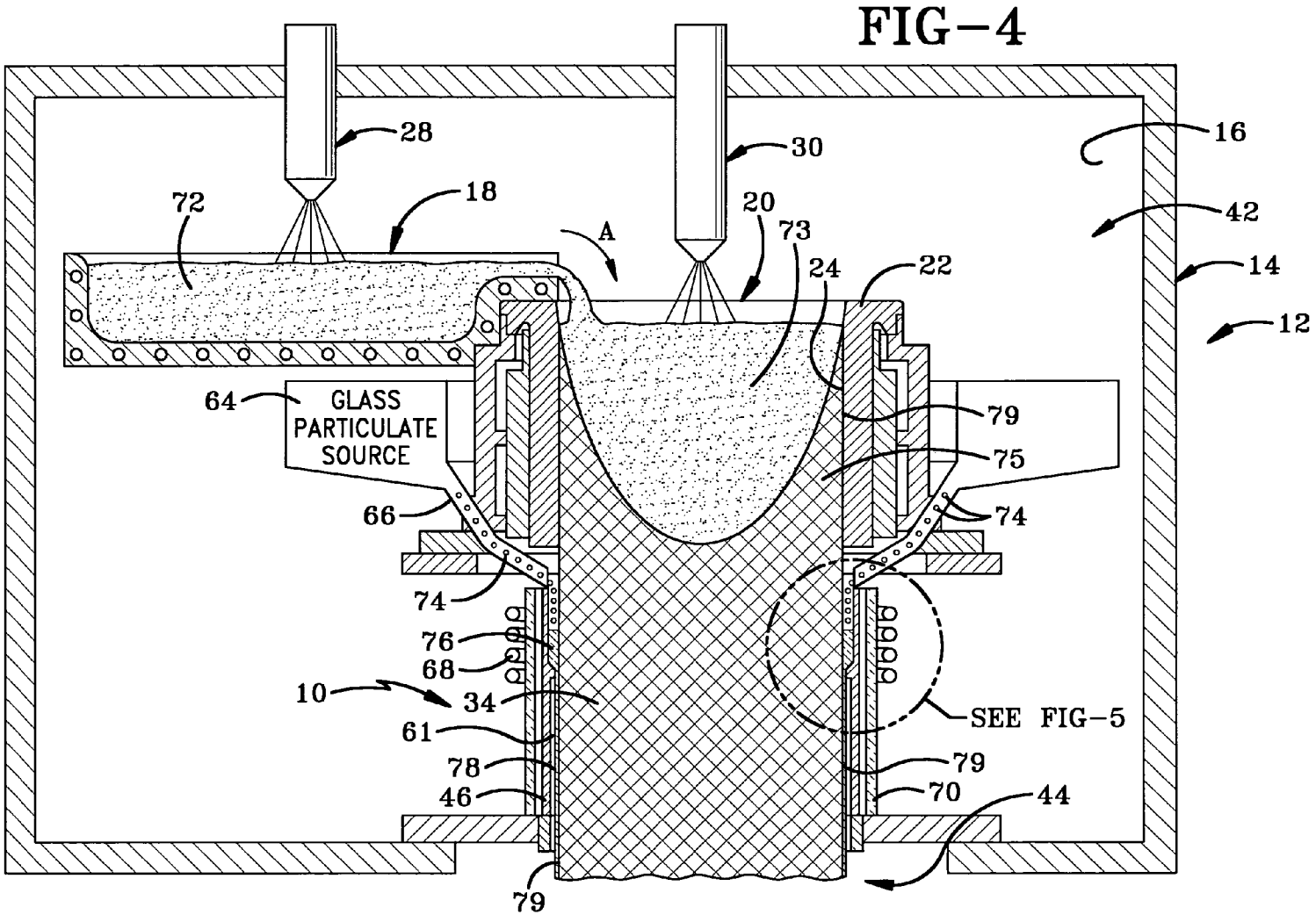
FIG. 4 is similar to FIG. 3 and shows a further stage of formation of the ingot and formation of the glass coating on the ingot.

Furnace 12 further includes a lift or withdrawal ram 32 for lowering a metal cast 34 (FIGS. 2-4). Any suitable withdrawal device may be used. Metal cast 34 may be in any suitable form, such as a round ingot, rectangular slab or the like. Ram 32 includes an elongated arm 36 with a mold support 38 in the form of a substantially cylindrical plate seated atop of arm 36. Mold support 38 has a substantially cylindrical outer surface 40 which is disposed closely adjacent inner surface 24 of mold 20 as ram 32 moves in a vertical direction. During operation, melting chamber 16 contains an atmosphere 42 which is non-reactive with reactive metals such as titanium and superalloys which may be melted in furnace 12. Inert gases may be used to form non-reactive atmosphere 42, particularly when using plasma torches, with which helium or argon are often used, most typically the former. Outside of chamber wall 14 is an atmosphere 44 which is reactive with the reactionary metals when in a heated state.

Seal 10 is configured to prevent reactive atmosphere 44 from entering melting chamber 16 during the continuous casting of reactionary metals such as titanium and superalloys. Seal 10 is also configured to protect the heated metal cast 34 when it enters reactive atmosphere 44. Seal 10 includes a passage wall or port wall 46 having a substantially cylindrical inner surface 47 defining passage 48 therewithin which has an entrance opening 50 and an exit opening 52. Port wall 46 includes an inwardly extending annular flange 54 having an inner surface or circumference 56. Inner surface 47 of port wall 46 adjacent entrance opening 50 defines an enlarged or wider section 58 of passage 48 while flange 54 creates a narrowed section 60 of passage 48. Below annular flange 54, inner surface 47 of port wall 46 defines an enlarged exit section 61 of passage 48.

As later explained, a reservoir 62 for a molten material such as liquid glass is formed during operation of furnace 12 in enlarged section 58 of passage 48. A source 64 of particulate glass or other suitable meltable material such as fused salt or slags is in communication with a feed mechanism 66 which is in communication with reservoir 62. Seal 10 may also include a heat source 68 which may include an induction coil, a resistance heater or other suitable source of heat. In addition, insulating material 70 may be placed around seal 10 to help maintain the seal temperature.

The operation of furnace 12 and seal 10 is now described with reference to FIGS. 2-5. FIG. 2 shows heat source 28 being operated to melt reactionary metal 72 within melting/refining hearth 18. Molten metal 72 flows as indicated by Arrow A into mold cavity 26 of mold 20 and is initially kept in a molten state by operation of heat source 30.

FIG. 3 shows ram 32 being withdrawn downwardly as indicated by Arrow B as additional molten metal 72 flows from hearth 18 into mold 20. An upper portion 73 of metal 72 is kept molten by heat source 30 while lower portions 75 of metal 72 begins to cool to form the initial portions of cast 34. Water-cooled wall 22 of mold 20 facilitates solidification of metal 72 to form cast 34 as ram 32 is withdrawn downwardly. At about the time that cast 34 enters narrowed section 60 (FIG. 2) of passage 48, particulate glass 74 is fed from source 64 via feed mechanism 66 into reservoir 62. While cast 34 has cooled sufficiently to solidify in part, it is typically sufficiently hot to melt particulate glass 74 to form liquid glass 76 within reservoir 62 which is bounded by an outer surface 79 of cast 34 and inner surface 47 of port wall 46. If needed, heat source 68 may be operated to provide additional heat through port wall 46 to help melt particulate glass 74 to ensure a sufficient source of liquid glass 76 and/or help keep liquid glass in a molten state. Liquid glass 76 fills the space within reservoir 62 and narrowed portion 60 to create a barrier which prevents external reactive atmosphere 44 from entering melting chamber 16 and reacting with molten metal 72. Annular flange 54 bounds the lower end of reservoir 62 and reduces the gap or clearance between outer surface 79 of cast 34 and inner surface 47 of port wall 46. The narrowing of passage 48 by flange 54 allows liquid glass 76 to pool within reservoir 62 (FIG. 2). The pool of liquid glass 76 in reservoir 62 extends around metal cast 34 in contact with outer surface 79 thereof to form an annular pool which is substantially cylindrical within passage 48. The pool of liquid glass 76 thus forms a liquid seal. After formation of this seal, a bottom door (not shown) which had been separating non-reactive atmosphere 42 from reactive atmosphere 44 may be opened to allow withdrawal of cast 34 from chamber 16.

Figure 5:
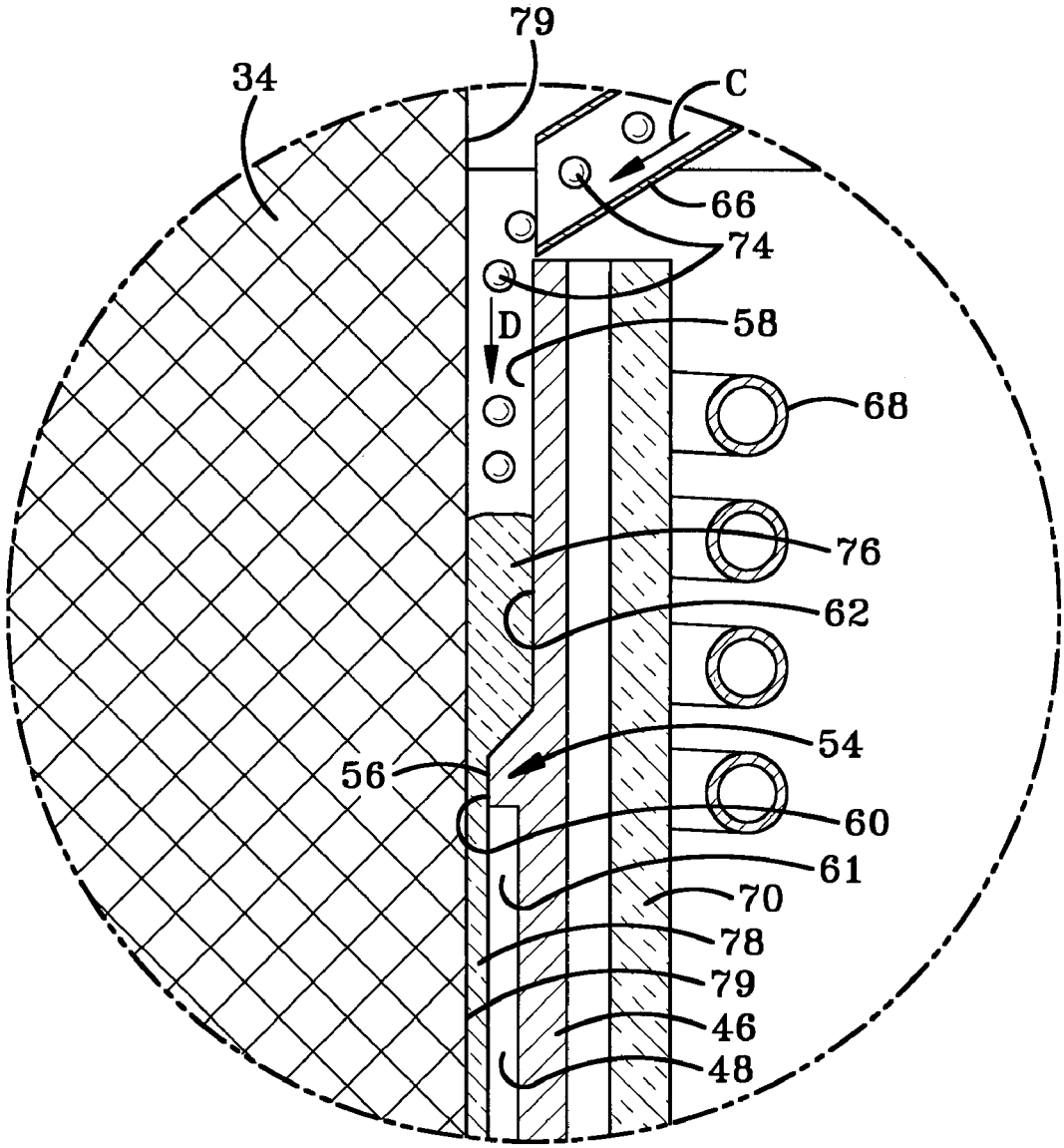
FIG. 5 is an enlarged view of the encircled portion of FIG. 4 and shows particulate glass entering the liquid glass reservoir and the formation of the glass coating.

As cast 34 continues to move downwardly as indicated in FIGS. 4-5, liquid glass 76 coats outer surface 79 of cast 34 as it passes through reservoir 62 and narrowed section 60 of passage 48. Narrowed section 60 reduces the thickness of or thins the layer of liquid glass 76 adjacent outer surface 79 of cast 34 to control the thickness of the layer of glass which exits passage 48 with cast 34. Liquid glass 76 then cools sufficiently to solidify as a solid glass coating 78 on outer surface 79 of cast 34. Glass coating 78 in the liquid and solid states provides a protective barrier to prevent reactive metal 72 forming cast 34 from reacting with reactive atmosphere 44 while cast 34 is still heated to a sufficient temperature to permit such a reaction.

FIG. 5 more clearly shows particulate glass 74 traveling through feed mechanism 66 as indicated by Arrow C and into enlarged section 58 (Arrow D) of passage 48 into reservoir 62 where particulate 74 is melted to form liquid glass 76. FIG. 5 also shows the formation of the liquid glass coating in narrowed section 60 of passage 48 as cast 34 moves downwardly. FIG. 5 also shows an open space between glass coating 78 and port wall 46 within enlarged exit section 61 of passage 48 as cast 34 with coating 78 move through section 61.

Figure 7:
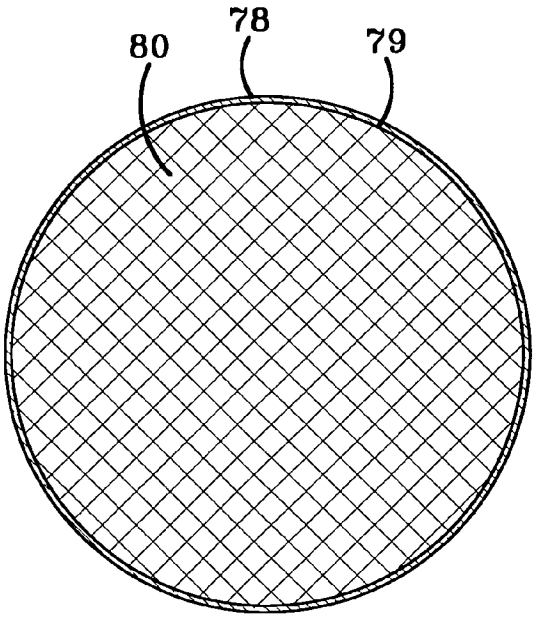
FIG. 7 is a sectional view taken on line 7-7 of FIG. 6.
Figure 6:
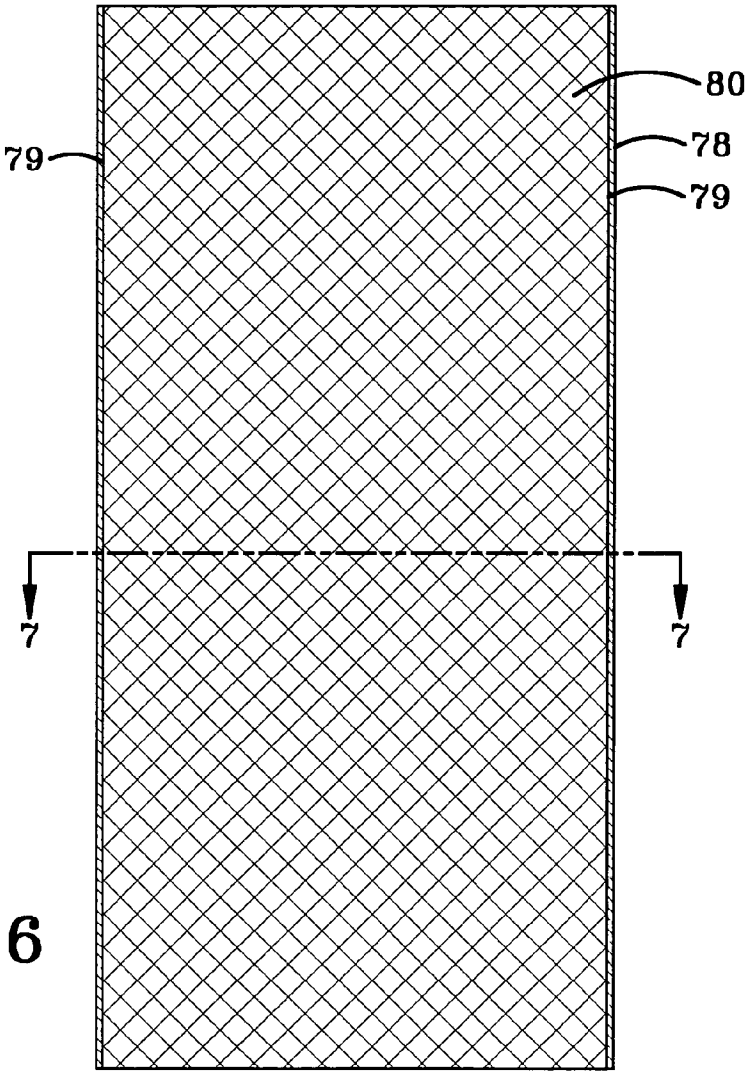
FIG. 6 is a sectional view of the ingot after being removed from the melting chamber of the furnace showing the glass coating on the outer surface of the ingot.

Once cast 34 has exited furnace 12 to a sufficient degree, a portion of cast 34 may be cut off to form an ingot 80 of any desired length, as shown in FIG. 6. As seen in FIGS. 6 and 7, solid glass coating 78 extends along the entire circumference of ingot 80.

Thus, seal 10 provides a mechanism for preventing the entry of reactive atmosphere 44 into melting chamber 16 and also protects cast 34 in the form of an ingot, bar, slab or the like from reactive atmosphere 44 while cast 34 is still heated to a temperature where it is still reactive with atmosphere 44. As previously noted, inner surface 24 of mold 20 is substantially cylindrical in order to produce a substantially cylindrical cast 34. Inner surface 47 of port wall 46 is likewise substantially cylindrical in order to create sufficient space for reservoir 62 and space between cast 34 and inner surface 56 of flange 54 to create the seal and also provide a coating of appropriate thickness on cast 34 as it passes downwardly. Liquid glass 76 is nonetheless able to create a seal with a wide variety of transverse cross-sectional shapes other than cylindrical. The transverse cross-sectional shapes of the inner surface of the mold and the outer surface of the cast are preferably substantially the same as the transverse cross-sectional shape of the inner surface of the port wall, particularly the inner surface of the inwardly extending annular flange in order that the space between the cast and the flange is sufficiently small to allow liquid glass to form in the reservoir and sufficiently enlarged to provide a glass coating thick enough to prevent reaction between the hot cast and the reactive atmosphere outside of the furnace. To form a metal cast suitably sized to move through the passage, the transverse cross-sectional shape of the inner surface of the mold is smaller than that of the inner surface of the port wall.

Additional changes may be made to seal 10 and furnace 12 which are still within the scope of the present invention. For example, furnace 12 may consist of more than a melting chamber such that material 72 is melted in one chamber and transferred to a separate chamber wherein a continuous casting mold is disposed and from which the passage to the external atmosphere is disposed. In addition, passage 48 may be shortened to eliminate or substantially eliminate enlarged exit section 61 thereof. Also, a reservoir for containing the molten glass or other material may be formed externally to passage 48 and be in fluid communication therewith whereby molten material is allowed to flow into a passage similar to passage 48 in order to create the seal to prevent external atmosphere from entering the furnace and to coat the exterior surface of the metal cast as it passes through the passage. In such a case, a feed mechanism would be in communication with this alternate reservoir to allow the solid material to enter the reservoir to be melted therein. Thus, an alternate reservoir may be provided as a melting location for the solid material. However, reservoir 62 of seal 10 is simpler and makes it easier to melt the material using the heat of the metal cast as it passes through the passage.

The seal of the present invention provides increased productivity because a length of the cast can be cut off outside the furnace while the casting process continues uninterrupted. In addition, yield is improved because the portion of each cast that is exposed when cut does not contain shrinkage or pipe cavities and the bottom of the cast does not have a dovetail. In addition, because the furnace is free of a withdrawal chamber, the length of the cast is not limited by such a chamber and thus the cast can have virtually any length that is feasible to produce. Further, by using an appropriate type of glass, the glass coating on the cast may provide lubrication for subsequent extrusion of the cast. Also the glass coating on the cast may provide a barrier when subsequently heating the cast prior to forging to prevent reaction of the cast with oxygen or other atmosphere.

While the preferred embodiment of the seal of the present invention has been described in use with glass particulate matter to form a glass coating, other materials may be used to form the seal and glass coating, such as fused salt or slags for instance.

The present apparatus and process is particularly useful for highly reactive metals such as titanium which is very reactive with atmosphere outside the melting chamber when the reactionary metal is in a molten state. However, the process is suitable for any class of metals, e.g. superalloys, wherein a barrier is needed to keep the external atmosphere out of the melting chamber to prevent exposure of the molten metal to the external atmosphere.

Figure 8:
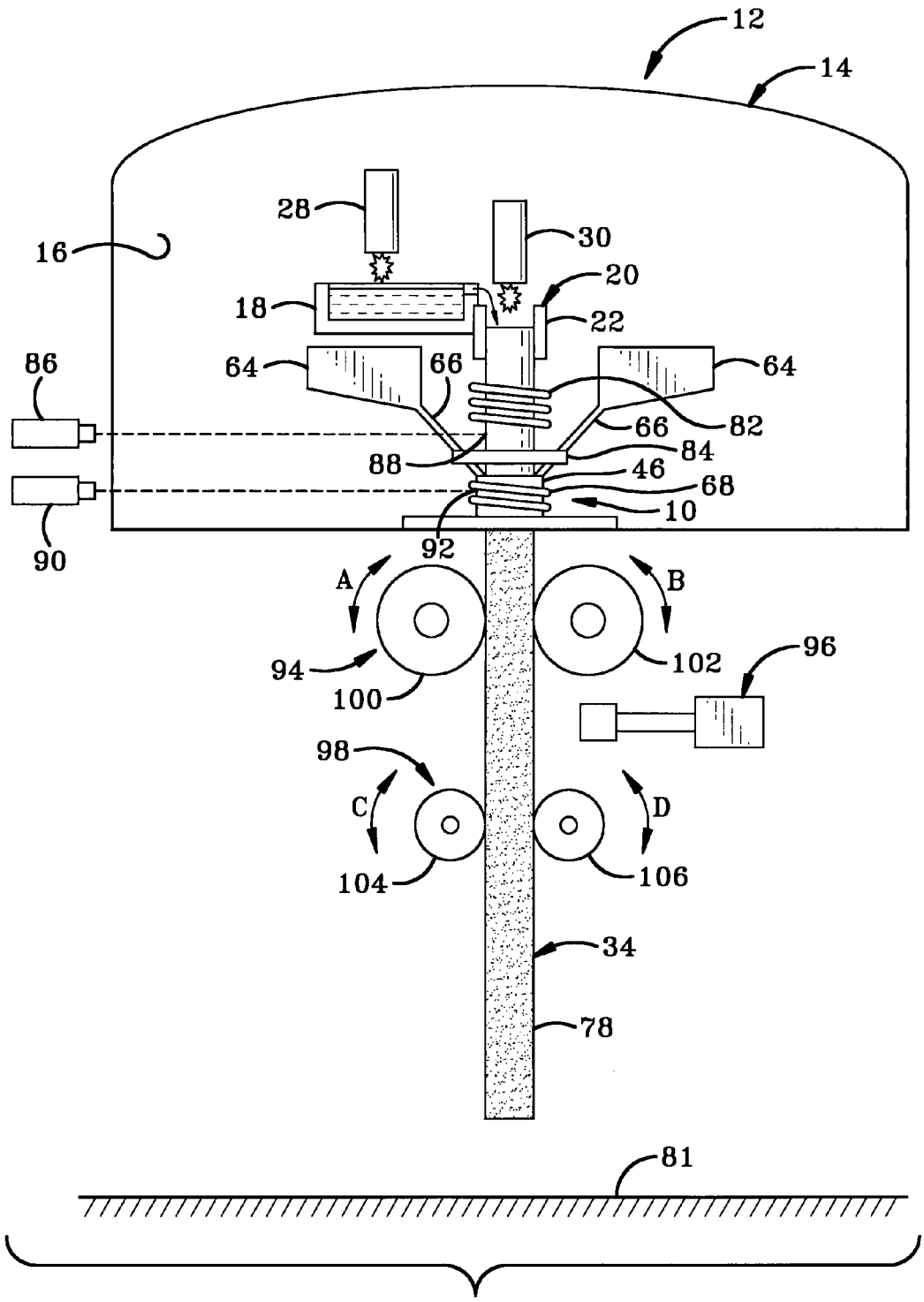
FIG. 8 is a diagrammatic elevational view of the continuous casting furnace of the present invention showing the ingot drive mechanism, the ingot cutting mechanism and the ingot handling mechanism with the newly produced coated metal cast extending downwardly external to the melting chamber and supported by the ingot drive mechanism and ingot handling mechanism.

With reference to FIG. 8, casting furnace 12 is further described. Furnace 12 is shown in an elevated position above a floor 81 of a manufacturing facility or the like. Within interior chamber 16, furnace 12 includes an additional heat source in the form of an induction coil 82 which is disposed below mold 20 and above port wall 46. Induction coil 82 circumscribes the pathway through which metal cast 34 passes during its travel toward the passage within passage wall 46. Thus, during operation, induction coil 82 circumscribes metal cast 34 and is disposed adjacent the outer periphery of the metal cast for controlling the heat of metal cast 34 at a desired temperature for its insertion into the passage in which the molten bath is disposed.

Also within interior chamber 16 is a cooling device in the form of a water cooled tube 84 which is used for cooling conduit 66 of the feed mechanism or dispenser of the particulate material in order to prevent the particulate material from melting within conduit 66. Tube 84 is substantially an annular ring which is spaced outwardly from metal cast 34 and contacts conduit 66 in order to provide for a heat transfer between tube 84 and conduit 66 to provide the cooling described.

Furnace 12 further includes a temperature sensor in the form of an optical pyrometer 86 for sensing the heat of the outer periphery of metal cast 34 at a heat sensing location 88 disposed near induction coil 82 and above port wall 46. Furnace 12 further includes a second optical pyrometer 90 for sensing the temperature at another heat sensing location 92 of port wall 46 whereby pyrometer 90 is capable of estimating the temperature of the molten bath within reservoir 62.

External to and below the bottom wall of chamber wall 14, furnace 12 includes an ingot drive system or lift 94, a cutting mechanism 96 and a removal mechanism 98. Lift 94 is configured to lower, raise or stop movement of metal cast 34 as desired. Lift 94 includes first and second lift rollers 100 and 102 which are laterally spaced from one another and are rotatable in alternate directions as indicated by Arrows A and B to provide the various movements of metal cast 34. Rollers 100 and 102 are thus spaced from one another approximately the same distance as the diameter of the coated metal cast and contact coating 78 during operation. Cutting mechanism 96 is disposed below rollers 100 and 102 and is configured to cut metal cast 34 and coating 78. Cutting mechanism 96 is typically a cutting torch although other suitable cutting mechanisms may be used. Removal mechanism 98 includes first and second removal rollers 104 and 106 which are spaced laterally from one another in a similar fashion as rollers 100 and 102 and likewise engage coating 78 of the coated metal cast as it moves therebetween. Rollers 104 and 106 are rotatable in alternate directions as indicated at Arrows C and D.

Additional aspects of the operation of furnace 12 are described with reference to FIGS. 8-10. Referring to FIG. 8, molten metal is poured into mold 20 as previously described to produce metal cast 34. Cast 34 then moves downwardly along a pathway from mold 20 through the interior space defined by induction coil 82 and into the passage defined by passage wall 46. Induction coils 82 and 68 and pyrometers 86 and 90 are part of a control system for providing optimal conditions to produce the molten bath within reservoir 62 to provide the liquid seal and coating material which ultimately forms protective barrier 78 on metal cast 34. More particularly, pyrometer 86 senses the temperature at location 88 on the outer periphery of metal cast 34 while pyrometer 90 senses the temperature of passage wall 46 at location 92 in order to assess the temperature of the molten bath within reservoir 62. This information is used to control the power to induction coils 82 and 68 to provide the optimal conditions noted above. Thus, if the temperature at location 88 is too low, induction coil 82 is powered to heat metal cast 34 to bring the temperature at location 88 into a desired range. Likewise, if the temperature at location 88 is too high, the power to induction coil 82 is reduced or turned off. Preferably, the temperature at location 88 is maintained within a given temperature range. Likewise, pyrometer 90 assesses the temperature at location 92 to determine whether the molten bath is at a desired temperature. Depending on the temperature at location 92, the power to induction coil 68 may be increased, reduced or turned off altogether to maintain the temperature of the molten bath within a desired temperature range. As the temperature of metal cast 34 and the molten bath is being controlled, water cooled-tube 84 is operated to provide cooling to conduit 66 in order to allow particulate material from source 64 to reach the passage within passage wall 46 in solid form to prevent clogging of conduit 66 due to melting therein.

With continued reference to FIG. 8, the metal cast moves through seal 10 in order to coat metal cast 34 to produce the coated metal cast which moves downwardly into the external atmosphere and between rollers 100 and 102, which engage and lower the coated metal cast downwardly in a controlled manner. The coated metal cast continues downwardly and is engaged by rollers 104 and 106.

Figure 9:
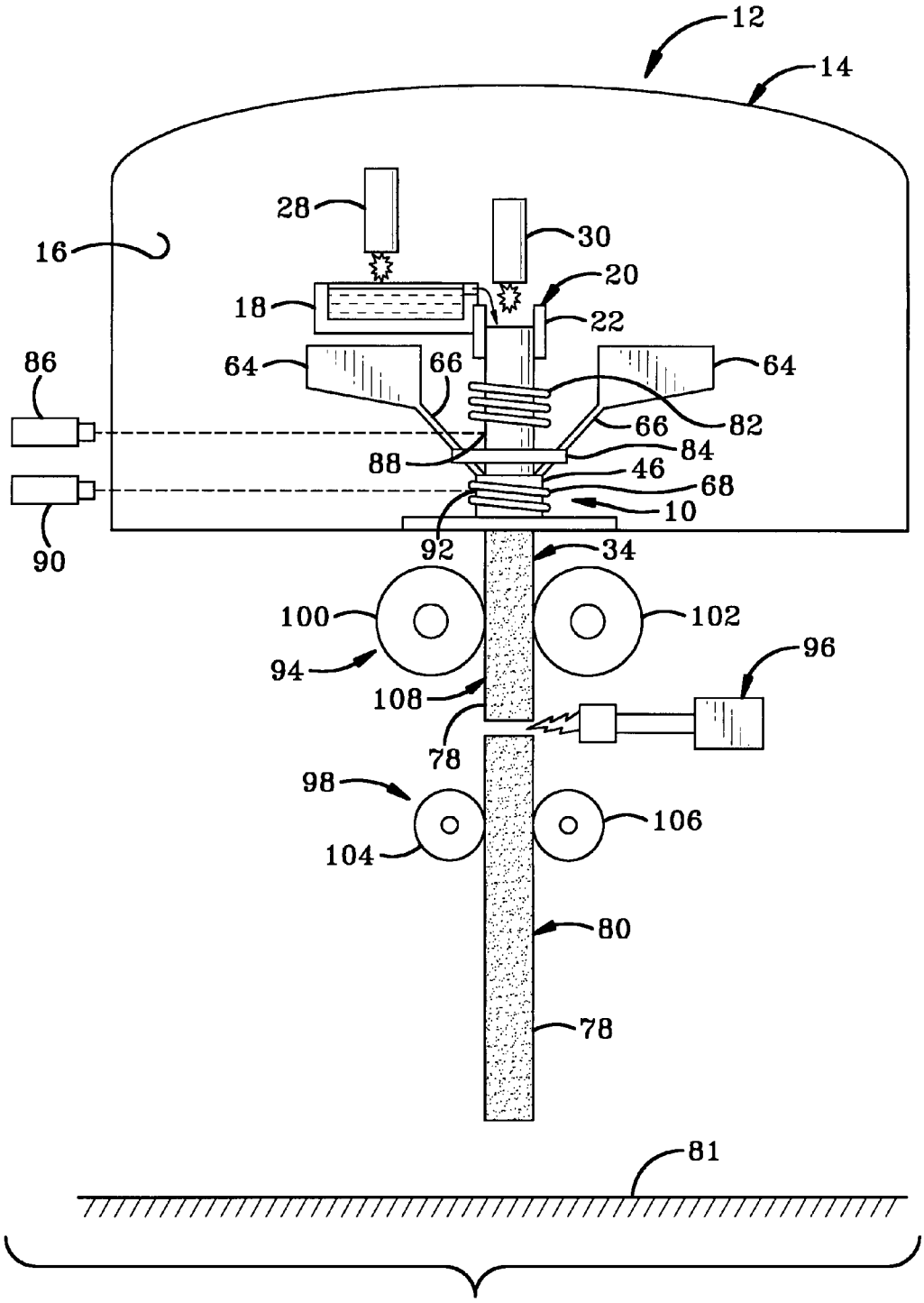
FIG. 9 is similar to FIG. 8 and shows a segment of the coated metal cast having been cut by the cutting mechanism.
Figure 10:
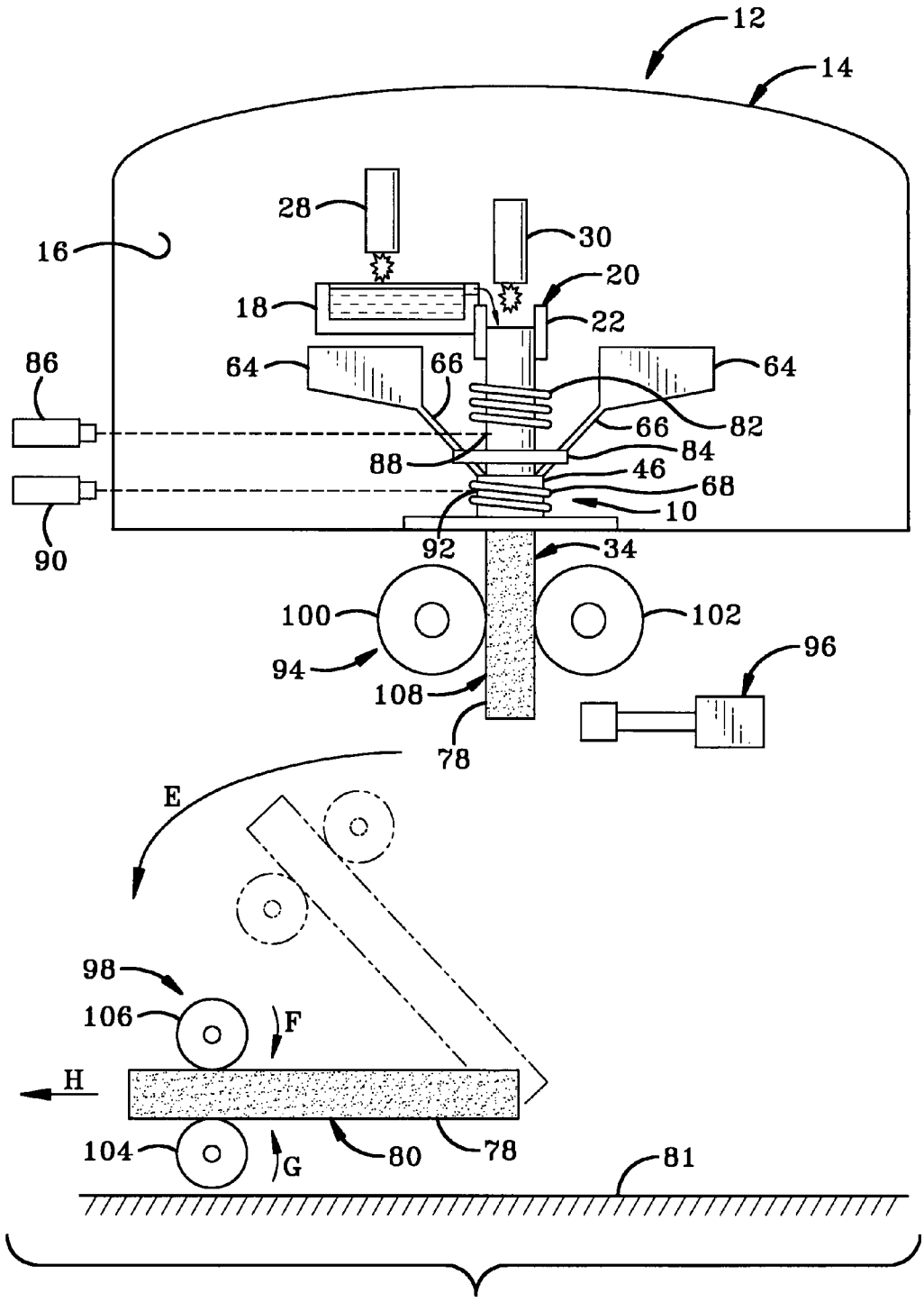
FIG. 10 is similar to FIG. 9 and shows the cut segment having been lowered for convenient handling thereof.

Referring to FIG. 9, cutting mechanism 96 then cuts the coated metal cast to form a cut segment in the form of coated ingot 80. Thus, by the time the coated metal cast reaches the level of cutting mechanism 96, it has cooled to a temperature at which the metal is substantially non-reactive with the external atmosphere. FIG. 9 shows ingot 80 in a cutting position in which ingot 80 has been separated from the parent segment 108 of metal cast 34. Rollers 104 and 106 then rotate as a unit from the receiving or cutting position shown in FIG. 9 downwardly toward floor 81 as indicated by Arrow E in FIG. 10 to a lowered unloading or discharge position in which ingot 80 is substantially horizontal. Rollers 104 and 106 are then rotated as indicated at Arrows F and G to move ingot 80 (Arrow H) to remove ingot 80 from furnace 12 so that rollers 104 and 106 may return to the position shown in FIG. 9 for receiving an additional ingot segment. Removal mechanism 98 thus moves from the ingot receiving position of FIG. 9 to the ingot unloading position of FIG. 10 and back to the ingot receiving position of FIG. 9 so that the production of metal cast 34 and the coating thereof via the molten bath is able to continue in a non-stop manner.

Figure 11:
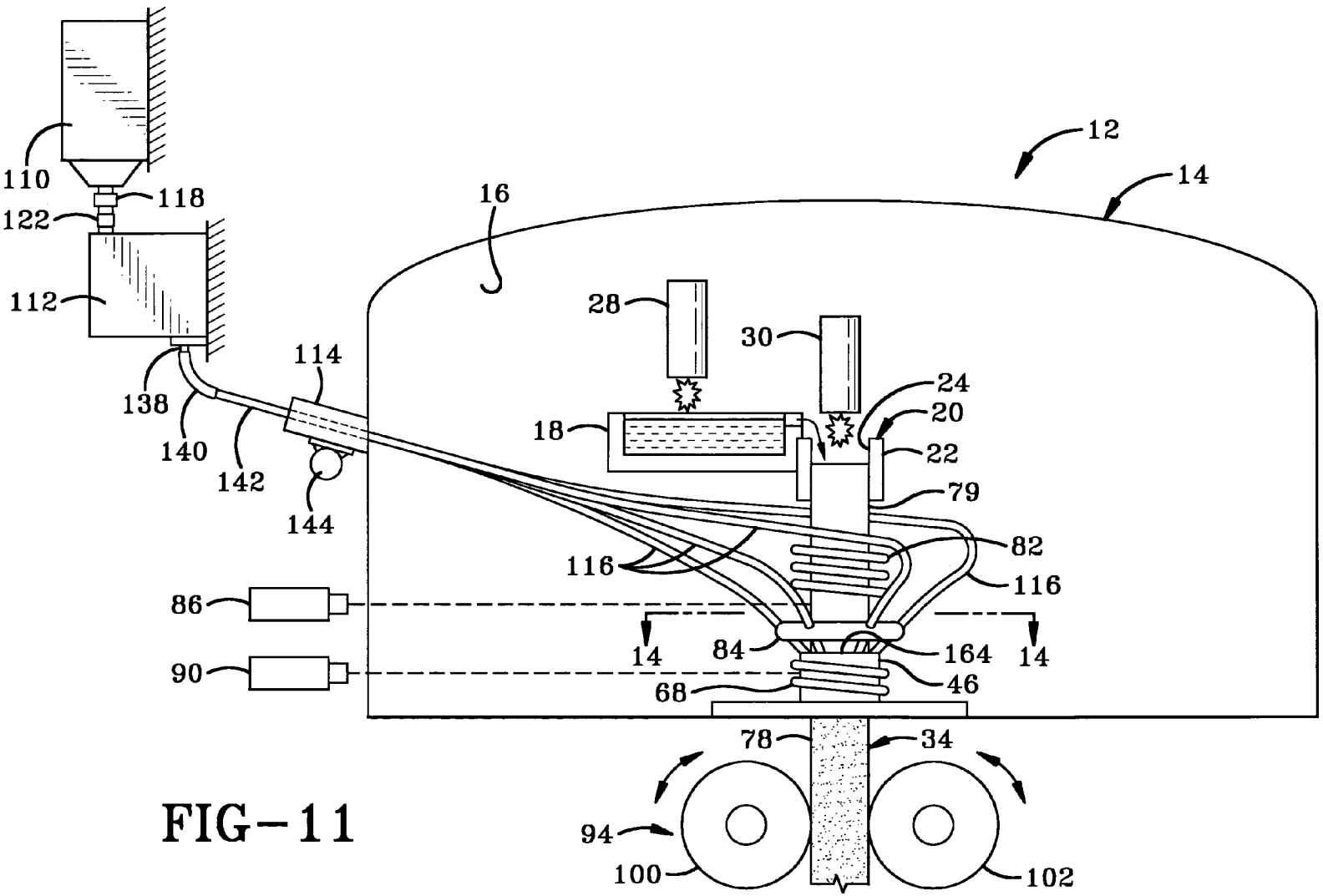
FIG. 11 is an enlarged diagrammatic elevational view similar to FIGS. 8-10 showing the feed system of the invention in greater detail.

The feed mechanism for feeding the solid particulate material of the present invention is now described in greater detail with reference to FIGS. 11-14. Referring to FIG. 11, the feed mechanism includes a hopper 110, a feed chamber 112, a mounting block 114 which is mounted on chamber wall 14 typically via welding, and a plurality of feed tubes 116 each of which is connected to and passes through cooling device 84. Four of feed tubes 116 are shown in FIG. 11 while all six of them are shown in FIG. 14. In practice, the number of feed tubes is typically between four and eight. These various elements of the feed mechanism provide a feed path through which the particles and solid coating material are fed into reservoir 62. Hopper 110, feed chamber 112 and feed tubes 116 are all sealed together with chamber 14 so that the atmosphere within each of these elements of the apparatus is the same. Typically, this atmosphere includes one of argon or helium and may be under a vacuum such as that associated with the use of plasma torches.

Figure 12:
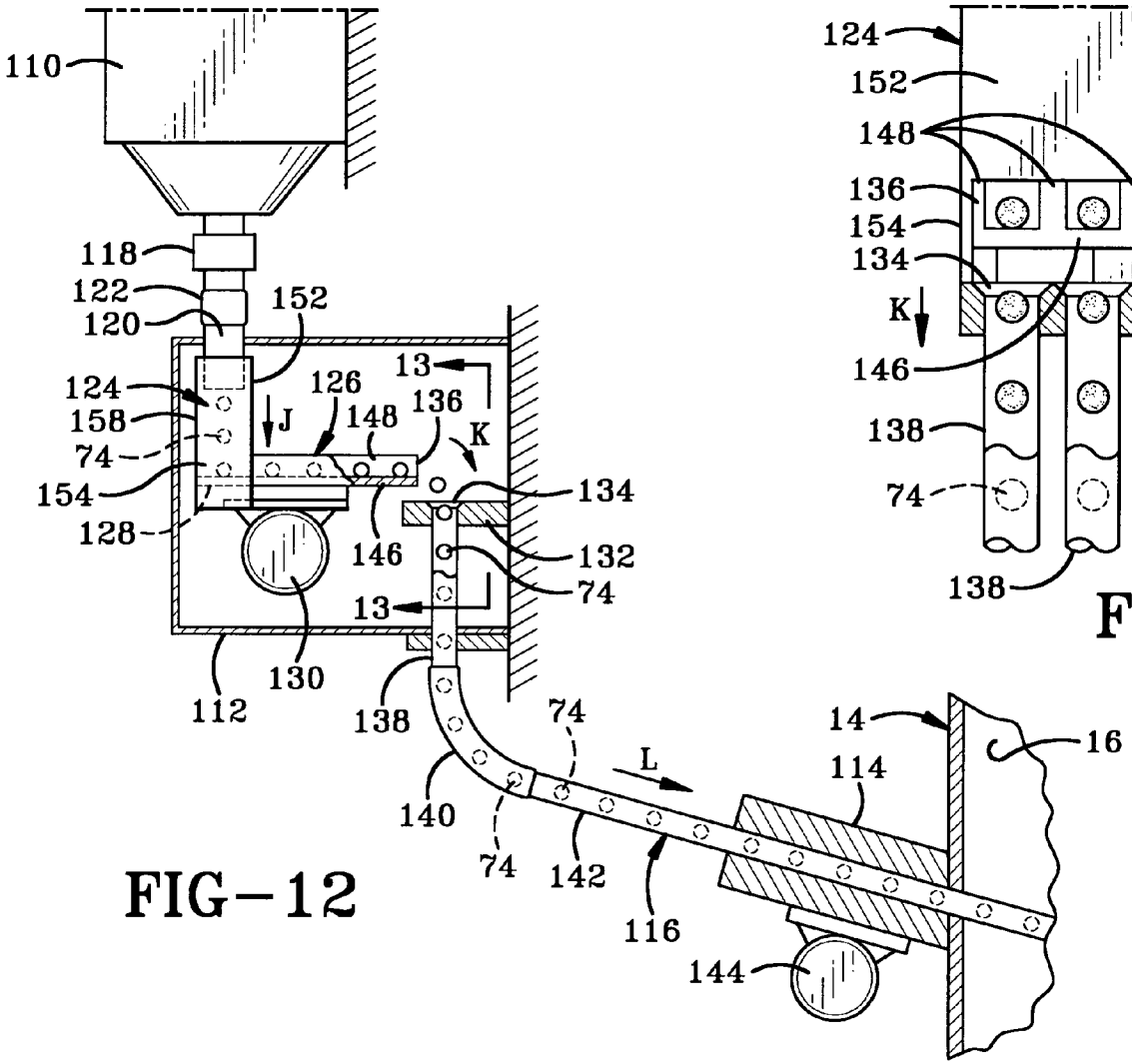
FIG. 12 is an enlarged fragmentary side elevational view of the hopper, feed chamber, feed tube and vibrators with portions shown in section.

Referring to FIG. 12, hopper 110 includes an exit port which is typically controlled by a valve 118. The exit port of hopper 110 communicates with a pipe mounted on the top wall of chamber 112 to provide an entry port 120 into said chamber. The connection between hopper 110 and entry port 120 preferably utilizes an annular coupler which may be formed as an elastomeric material which maintains the seal between hopper 110 and chamber 112 and allows for the removability of hopper 110 to be replaced with another hopper to expedite the switchover process during refilling of hopper 110. Entry port 120 feeds into a container or housing 124 disposed within chamber 112 which is connected to a vibratory feed tray 126 and extends upwardly from an entry end 128 thereof. A variable speed vibrator 130 is mounted on the bottom of tray 126 for vibrating said tray. A feed block 132 is mounted within chamber 112 and defines a plurality of beveled feed holes 134 below to an exit end 136 of tray 126. Each feed tube 116 includes a first tube segment 138 connected to feed block 132 in communication with holes 134. Each first tube segment 138 is connected to the bottom wall of chamber 112 and extends therethrough. Each feed tube 116 further includes a second flexible tube segment 140 connected to an exit end of first segment 138 and a third tube segment 142 connected to an exit end of flexible segment 140. Flexible segments 140 in part compensate for any misalignment between respective first and third segments 138 and 142. Each tube segment 142 extends continuously from a second tube segment 140 to an exit end above end wall 46 (FIG. 11). Thus, block 114 has a plurality of passages formed therethrough through which segments 142 extend. Another vibrator 144 is mounted on the bottom of block 114 to vibrate said block and tube segments 142.

Figure 13:
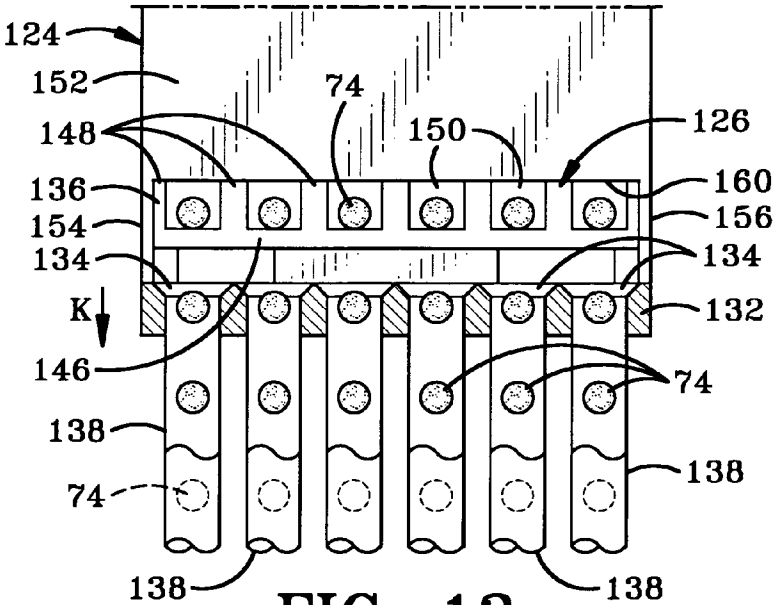
FIG. 13 is a sectional view taken on line 13-13 of FIG. 12.
Figure 14:
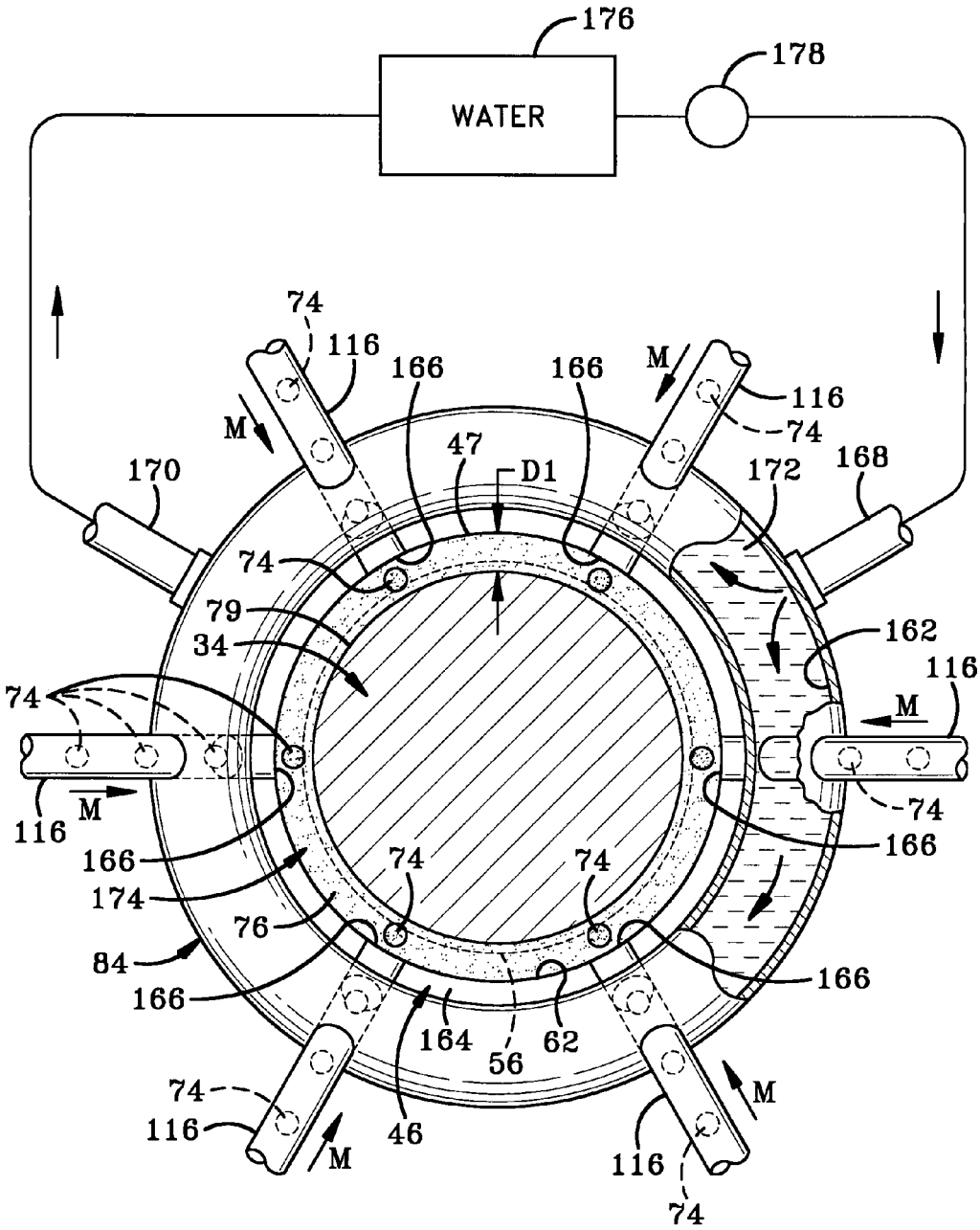
FIG. 14 is sectional view taken on line 14-14 of FIG. 11.

Referring to FIG. 13, housing 124 and feed tray 126 are described in further detail. Tray 126 includes a substantially horizontal bottom wall 146 and seven channel walls 148 defining therebetween six channels 150 each extending from entry end 128 to exit end 136. While the dimensions of channels 150 may vary, in the exemplary embodiment they are approximately one half inch wide and one half inch high. Housing 124 includes a front wall 152, a pair of side walls 154 and 156 connected thereto and a rear wall 158 (FIG. 12) connected to each of side walls 154 and 156. Side walls 154 and 156 and rear wall 158 extend downwardly to abut bottom wall 146 of tray 126. However, front wall 152 has a bottom edge 160 which is seated atop channel wall 148 to create exit openings each bounded by bottom edge 160, bottom wall 146 and a pair of adjacent channel walls 148.

Referring to FIG. 14, cooling ring 84 is further described. Ring 84 has an annular configuration and is of a tubular structure which defines an annular passage 162. Ring 84 circumscribes the metal cast pathway through which metal cast 34 passes during the casting process. Ring 84 is disposed fairly close to cast 34 and a top surface 164 of wall 46 in order to provide cooling to feed tubes 116 adjacent respective exit ends 166 thereof. Ring 84 has entry and exit ports 168 and 170 to allow for the circulation of water 172 through ring 84. Entry port 168 is in communication with a source 176 of water and a pump 178 for pumping the water through ring 84 indicated by corresponding arrows in FIG. 14. A plurality of holes are formed in the side wall of ring 84 through which the smaller diameter feed tubes 116 pass in order to allow water 172 to directly contact feed tubes 116 adjacent their exit ends 166. Each feed tube 116 adjacent exit end 166 is closely adjacent or in abutment with top surface 164 of wall 46. Each exit end 166 and inner surface 47 of port wall 46 is spaced from outer periphery 79 of metal cast 34 by a distance D1 shown in FIG. 14. Distance D1 is typically in the range of ½ to ¾ inch and preferably is no more than one inch.

Furnace 12 is configured with a metal cast pathway which extends downwardly from the bottom of mold 20 and through the passage of reservoir wall 46. This pathway has a horizontal cross sectional shape which is the same as outer periphery 79 of cast 34, which is substantially identical to the cross sectional shape of inner surface 24 of casting mold 20. Thus, distance D1 also represents the distance from the metal cast pathway to inner surface 47 of wall 46 and the distance between said pathway and exit ends 166 of feed tubes 116.

The particulate coating material is shown as substantially spherical particles 74 which are fed along the feed path from hopper 110 to reservoir 62. It has been found that a soda-lime glass works well as the coating material due in part to the availability of such glass in substantially spherical form. Due to the relatively long pathway along which particles 74 must travel while maintaining control of their flow downstream toward reservoir 62, the use of spherical particles 74 has been found to greatly facilitate the feeding process through conduits 116 which are positioned at an angle suitable to maintain this controlled flow. The segments 142 of feed tubes 116 are disposed along a generally constant angle in spite of the diagrammatic view shown in FIG. 11. Particles 74 have a particle size somewhere within the range of 5 to 50 mesh; and more typically within narrower ranges such as, for example, 8 to 42 mesh; 10 to 36 mesh; 12 to 30 mesh; 14 to 24 mesh and most preferably 16 to 18 mesh.

The operation of the feed system is now described with reference to FIGS. 11-14. Initially, hopper 110 is filled with a substantial amount of particles 74 and valve 118 is positioned to allow the flow thereof via entry port 120 into housing 124 in chamber 112 as indicated at arrow J so that housing 124 becomes partially filled with particles 74. Vibrator 130 is then operated at a desired vibrational rate to vibrate tray 126 and particles 74 to facilitate their movement along channels 150 toward exit end 136, where particles 74 fall off of tray 126 and into tube segments 138 via holes 134 as indicated at arrows K in FIGS. 12 and 13. Particles 74 continue their movement through tube segments 140 and into tube segments 142 as indicated at arrow L toward block 114. Vibrator 144 is operated to vibrate block 114, tube segments 142 and particles 74 passing therethrough to additionally facilitate their movement toward reservoir 62. The spherical shape of particles 74 allows them to roll through conduits 116 and along the various other surfaces of the feed path, substantially facilitating their travel.

Particles 74 complete their travel along the feed path as they reach ends 166 and exit feed tubes 116 therefrom, as shown in FIG. 14. Particles 74 are pre-heated as they travel through segments 142 within the melting chamber, which is accentuated by their small size. However, particles 74 are maintained in the solid state until after they move beyond ends 166 to insure that feed tubes 116 do not become clogged with molten coating material. To insure that particles 74 do not melt within feed tube 116 adjacent exit ends 166, and to insure the integrity of feed tubes 116 in that region, pump 178 (FIG. 14) is operated to pump water from source 176 through ring 84 via entry and exit ports 168 and 170 so that water 172 directly contacts the outer perimeters of feed tubes 116 where they pass through passage 162 of ring 84. Thus, particles 74 are in the solid state at a distance from outer periphery 79 of metal cast 34 which is even less than distance D1. However, particles 74 are rapidly melted largely due to the heat radiating from the newly formed cast 34, with any additional heat needed provided by coil 68. Particles 74 thus are melted at a melting location 174 bounded by outer surface 79 of cast 34 and inner surface 47 of port wall 46, thus within distance D1 of outer periphery 79 of metal cast 34.

Thus, furnace 12 provides a simple apparatus for continuously casting and protecting metal casts which are reactionary with external atmosphere when hot so that the rate of production is substantially increased and the quality of the end product is substantially improved.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a continuous casting mold adapted for producing a metal casting having an outer periphery;

a metal casting pathway extending downwardly from the mold adapted to allow the metal casting to pass therethrough;

a reservoir adjacent the pathway adapted to contain a molten bath for applying a coating of molten material to the outer periphery of the metal casting;

a feed path communicating with the reservoir and adapted for feeding solid particles into the reservoir; and a first vibrator adjacent the feed path for vibrating the feed path.

2. The apparatus of claim 1 further comprising a feed tray on the feed path vibratable in response to vibration of the first vibrator.

3. The apparatus of claim 2 further comprising a second vibrator; and a feed tube on the feed path which is in communication with and downstream of the feed tray and which is vibratable in response to vibration of the second vibrator.

4. The apparatus of claim 1 further comprising a feed tube on the feed path vibratable in response to vibration of the first vibrator.

5. The apparatus of claim 4 further comprising an interior chamber bounded by a sidewall; and a block mounted on the sidewall; and wherein the feed tube and first vibrator are mounted on the block; and the reservoir is in the interior chamber.

6. The apparatus of claim 1 further comprising a plurality of feed tubes on the feed path communicating with the reservoir; and a plurality of channels on the feed path in respective communication with and upstream of the feed tubes for dividing flow of the particles into the feed tubes.

7. The apparatus of claim 6 wherein the plurality of channels have respective entry ends for receiving the particles and respective exit ends aligned for feeding the particles into the feed tubes.

8. The apparatus of claim 7 further comprising a container on the feed path mounted on and extending upwardly from the channels above the entry ends.

9. The apparatus of claim 6 further comprising a container on the feed path in communication with and upstream of the channels.

10. The apparatus of claim 1 wherein the feed path has an exit end communicating with the reservoir; and further comprising a cooling device adjacent the exit end of the feed path for cooling the feed path.

11. The apparatus of claim 10 wherein the cooling device comprises a pipe; a fluid entry port on the pipe; and a fluid exit port on the pipe.

12. The apparatus of claim 11 wherein the pipe defines a passage communicating with the entry and exit ports; and further comprising a feed tube on the feed path which has an exit end communicating with the reservoir and which adjacent its exit end passes through the pipe and its passage whereby the cooling device is configured to allow liquid moving through the passage via the entry and exit ports to directly contact the feed tube adjacent its exit end.

13. The apparatus of claim 12 wherein the pipe circumscribes the pathway; and a plurality of the feed tubes pass through the pipe.

14. The apparatus of claim 1 wherein the mold has an inner periphery; the metal casting pathway has an outer perimeter substantially identical to the inner periphery of the mold and extending from the mold to the reservoir; and the feed path has an exit end which communicates with the reservoir and is within 1.0 inch of the outer perimeter of the pathway.

15. The apparatus of claim 1 further comprising a reservoir wall having an inner periphery adapted to bound the molten bath; and wherein the mold has an inner periphery; the metal casting pathway has an outer perimeter substantially identical to the inner periphery of the mold and extending from the mold to the reservoir; and no portion of the inner periphery of the reservoir wall is more than 1.0 inch from the outer perimeter of the pathway.

16. The apparatus of claim 1 further comprising the solid particles; and at least one feed tube on the feed path; and wherein the particles are substantially spherical whereby they are configured to roll through the at least one feed tube.

17. The apparatus of claim 16 wherein the particles have a size in the range of 10 to 30 mesh.

18. The apparatus of claim 1 further comprising the solid particles; and wherein the particles have a size in the range of 5 to 50 mesh.

19. The apparatus of claim 18 wherein the particles have a size in the range of 10 to 30 mesh.

20. The apparatus of claim 19 wherein the particles have a size in the range of 12 to 30 mesh.

21. The apparatus of claim 20 wherein the particles have a size in the range of 14 to 24 mesh.

22. The apparatus of claim 21 wherein the particles have a size in the range of 16 to 18 mesh.

23. The apparatus of claim 1 wherein the feed path comprises at least four feed tubes having respective exit ends which are circumferentially spaced from one another and communicate with the reservoir.

24. The apparatus of claim 23 wherein the feed path comprises from four to eight feed tubes having respective exit ends which are circumferentially spaced from one another and communicate with the reservoir.

25. The apparatus of claim 1 further comprising at least one feed tube on the feed path which communicates with the reservoir and comprises a first tube segment having an exit end, a second flexible tube segment having an exit end and an entry end connected to the exit end of the first tube segment, and a third tube segment having an entry end connected to the exit end of the second flexible tube segment.

26. An apparatus comprising:

a continuous casting mold adapted for producing a metal casting having an outer periphery;

a metal casting pathway extending downwardly from the mold adapted to allow the metal casting to pass therethrough;

a reservoir adjacent the pathway adapted to contain a molten bath for applying a coating of molten material to the outer periphery of the metal casting;

a solid-particle feed path having an exit end communicating with the reservoir and adapted for feeding solid particles into the reservoir; and a cooling device adjacent the exit end of the feed path for cooling the feed path.

27. The apparatus of claim 26 further comprising a pipe on the cooling device defining a passage having entry and exit ports; and a plurality of feed tubes on the feed path which have respective exit ends communicating with the reservoir, the feed tubes passing through the pipe and its passage adjacent their exit ends whereby the cooling device is configured to allow liquid moving through the passage via its entry and exit ports to directly contact the feed tubes adjacent their exit ends.

28. An apparatus comprising:

a continuous casting mold adapted for producing a metal casting having an outer periphery;

a metal casting pathway extending downwardly from the mold adapted to allow the metal casting to pass therethrough;

a reservoir adjacent the pathway adapted to contain a molten bath for applying a coating of molten material to the outer periphery of the metal casting;

a container adapted to contain solid particles;

a plurality of feed tubes communicating with the reservoir and adapted for feeding the solid particles into the reservoir; and a plurality of channels on the feed path in communication with and downstream of the container and in respective communication with and upstream of the feed tubes for dividing flow of the particles from the container into the feed tubes.

29. The apparatus of claim 28 further comprising a substantially horizontal bottom wall defining the bottom of each channel.

30. The apparatus of claim 29 further comprising a feed tray defining the channels; respective entry ends on the channels for receiving the particles; respective exit ends on the channels aligned for feeding the particles into the feed tubes; and wherein the container is mounted on the feed tray and extends upwardly from the channels above the entry ends.

* * * * *